US005320301A

United States Patent [19]

Cross

[11] Patent Number: 5,320,301

[45] Date of Patent: Jun. 14, 1994

[54] WIRE REEL FOR HANDLING COILS OF WIRE

[75] Inventor: Dan A. Cross, Seattle, Wash.

[73] Assignee: The Boeing Company, Seattle, Wash.

[21] Appl. No.: 892,153

[22] Filed: Jun. 2, 1992

[51] Int. Cl.[5] ..... B65H 49/00; B65H 75/14; B65H 75/28

[52] U.S. Cl. ..... 242/129; 242/118.4; 242/125.1; 242/125.2

[58] Field of Search ..... 242/129, 54 R, 125, 242/125.1, 125.2, 125.3, 118.4, 117, 99, 132, 137, 146

[56] References Cited

U.S. PATENT DOCUMENTS

| | | | |
|---|---|---|---|
| 766,936 | 8/1904 | De Roseau . | |
| 856,173 | 6/1907 | Mitchell . | |
| 1,531,147 | 3/1925 | Smith . | |
| 2,181,766 | 11/1939 | Neats et al. | 242/139 |
| 2,659,573 | 11/1953 | Smith, Sr. | 242/99 |
| 2,716,008 | 8/1955 | Taylor, Jr. | 242/159 |
| 3,175,679 | 3/1965 | Bratz | 206/52 |
| 3,272,455 | 9/1966 | Sternberg et al. | 242/171 |
| 3,727,858 | 4/1973 | Cornwell et al. | 242/129 |
| 4,520,966 | 6/1985 | Bloch et al. | 242/54 |
| 4,638,558 | 1/1987 | Eaton | 29/861 |
| 4,653,159 | 3/1987 | Henderson et al. | 29/33 |
| 4,677,734 | 7/1987 | Bloch et al. | 29/564.2 |
| 4,685,636 | 8/1987 | Eaton | 242/129 |
| 4,715,549 | 12/1987 | Travlos | 242/25 |
| 4,715,557 | 12/1987 | Rushing et al. | 242/129 |
| 4,718,633 | 1/1988 | Weixel | 242/129 |
| 4,796,830 | 1/1989 | Gelfman | 242/125.1 |
| 4,803,778 | 2/1989 | Cross | 29/857 |

FOREIGN PATENT DOCUMENTS

| | | | |
|---|---|---|---|
| 875573 | 5/1953 | Fed. Rep. of Germany | 242/125.2 |
| 2558814 | 8/1985 | France . | |
| 508258 | 1/1955 | Italy . | |

*Primary Examiner*—Stanley N. Gilreath
*Attorney, Agent, or Firm*—Joan H. Pauly; Bruce A. Kaser

[57] ABSTRACT

The invention disclosed here is a wire reel that is designed to be used in connection with an automated wire handling system. The reel has a generally planar stiffback, and a circular flange that is releasably connected to the stiffback. The stiffback and flange together define a circular winding space for coiling a wire onto the reel. The stiffback also carries two, spaced-apart clamps which are positioned outwardly with respect to the outer perimeter of the flange. These clamps hold the opposite ends of the coiled wire. The stiffback is shaped so that it is suitable for gripping and handling by a robotic arm or the like.

12 Claims, 6 Drawing Sheets

WIRE REEL FOR HANDLING COILS OF WIRE

TECHNICAL FIELD

The present invention generally relates to reels or spools for holding coiled wire segments, and more particularly, to machine-driven reels that are used for winding such segments as part of an automated manufacturing environment.

RELATED PATENTS AND PATENT APPLICATIONS

The following United States patents and/or patent applications are related to the subject matter of the present invention: U.S. Ser. No. 590,650, filed Sep. 28, 1990, for a "Wire Harness Manufacturing System", now U.S. Pat. No. 5,153,839; U.S. Ser. No. 590,661, filed Sep. 28, 1990, for an "Automated Termination Station and Method of Using the Same" now U.S. Pat. No. 5,125,154; U.S. Ser. No. 07/892,275, filed Jun. 2, 1992, for a "Pin Hub for Wire Reel"; U.S. Pat. No. 4,803,778, issued on Feb. 14, 1989, for a "Method for Making a Wire Harness"; and U.S. Pat. No. 4,520,966, issued on Jun. 4, 1985, for a "Wire Canister for a Robotic Wire Harness Assembly System".

BACKGROUND ART

As is well-known, automation is becoming increasingly prevalent in manufacturing. In the aircraft industry, for example, the trend is to automate as many manufacturing operations as possible in conjunction with producing commercial aircraft.

The wiring systems of commercial aircraft usually involve the use of large numbers of wire harnesses. Such harnesses are typically or bound together by hand. This is extremely labor intensive, and significant cost savings could be achieved if such process were automated.

Accordingly, The Boeing Company, who is the assignee of the present invention, has been involved in developing an automated system for producing wire harnesses for Boeing aircraft. A portion of the system presently under development is disclosed in U.S. Pat. No. 4,803,778, which was identified above.

Obviously, large numbers of wires are involved in producing the various harnesses that Boeing requires. If the harnesses are to be assembled by an automated system, then in order to operate efficiently, virtually all aspects of handling the individual wire segments that go into a particular harness must be automated, from the time each segment is drawn from a bulk storage spool and cut to length, until the segment is subsequently installed as part of a harness. In addition to developing machinery that can handle segments during the harness assembly process, there is a related requirement to have wire-handling machinery that can move coils or individual segments of wire from one assembly station to another, or to automatically store segments until needed. For this reason, there is a need to have well-designed recyclable wire reel cartridges that are essentially interchangeable and suitable for use in conjunction with robotic arms.

It has been estimated that the system disclosed in the '778 patent will require a recyclable wire reel for each wire segment that is to be processed into a harness. Certain known attempts to produce recyclable wire reels are disclosed in U.S. Pat. Nos. 3,727,858; 4,685,636; and 4,715,549. The present invention is a new type of reel which, it is believed, has advantages over and above the reels disclosed in these patents or what is otherwise known about the prior art.

SUMMARY OF THE INVENTION

The invention is a wire reel or wire handler cartridge that enables a wire segment to be coiled or spooled onto the reel, and clamped and possibly tied while in coiled form. If tied, the coil may thereafter be removed from the reel. Otherwise, the coil remains clamped on the reel for later use. Removal of the coil is mainly dependent on the number of reels available for storage purposes.

A reel in accordance with the invention has a rigid, generally planar stiffback member, and a flange member with a central hub that is removably connected to the stiffback member. The stiffback member has portions that are shaped so that it is easy to be engaged with or gripped by a robotic arm, or another type of robotic handling device. The stiffback member has a substantially flat surface that faces the flange member. An outer peripheral portion of the flange member, which is preferably circular, is spaced apart from such surface. This creates or defines a winding or coiling space for spooling a wire segment onto and off of the reel between the flange member and the stiffback member.

The stiffback member carries two spaced-apart wire clamps, one each for holding opposite ends of the coiled wire segment in predetermined positions. It is important that the wire ends are held in known positions so that they may be further manipulated or otherwise processed by automated machinery like, for example, the type of system disclosed in U.S. Pat. No. 4,803,778.

The stiffback member defines a flat winding plane for coiling the wire segment. It has a V-shaped groove that extends between the wire clamps and defines a path or guideway for the leading end of the wire.

Each clamp is generally made of an elastically-flexible member, such as a strip of flexible spring steel. An opening extends through the stiffback member at the location of each clamp. Such opening enables an actuator member to extend through the opening, and push against the c lamp, thereby pushing it away from the groove. This creates a path of travel for the wire between the clamp and groove, and enables the leading end of the wire to be passed along the groove, and underneath the clamp. Thereafter, the actuator member retracts, enabling the clamp to elastically return to a normal position and press the wire between the clamp and the stiffback, thereby clamping it in position.

The invention as generally summarized above, will become more clearly understood upon consideration of the following description, which is to be read in conjunction with the appended drawings.

BRIEF DESCRIPTION OF THE DRAWINGS

In the drawings, like reference numerals and letters refer to like parts throughout the various views, unless specifically indicated otherwise, and wherein.

BEST MODE FOR CARRYING OUT THE INVENTION

Figure 1:
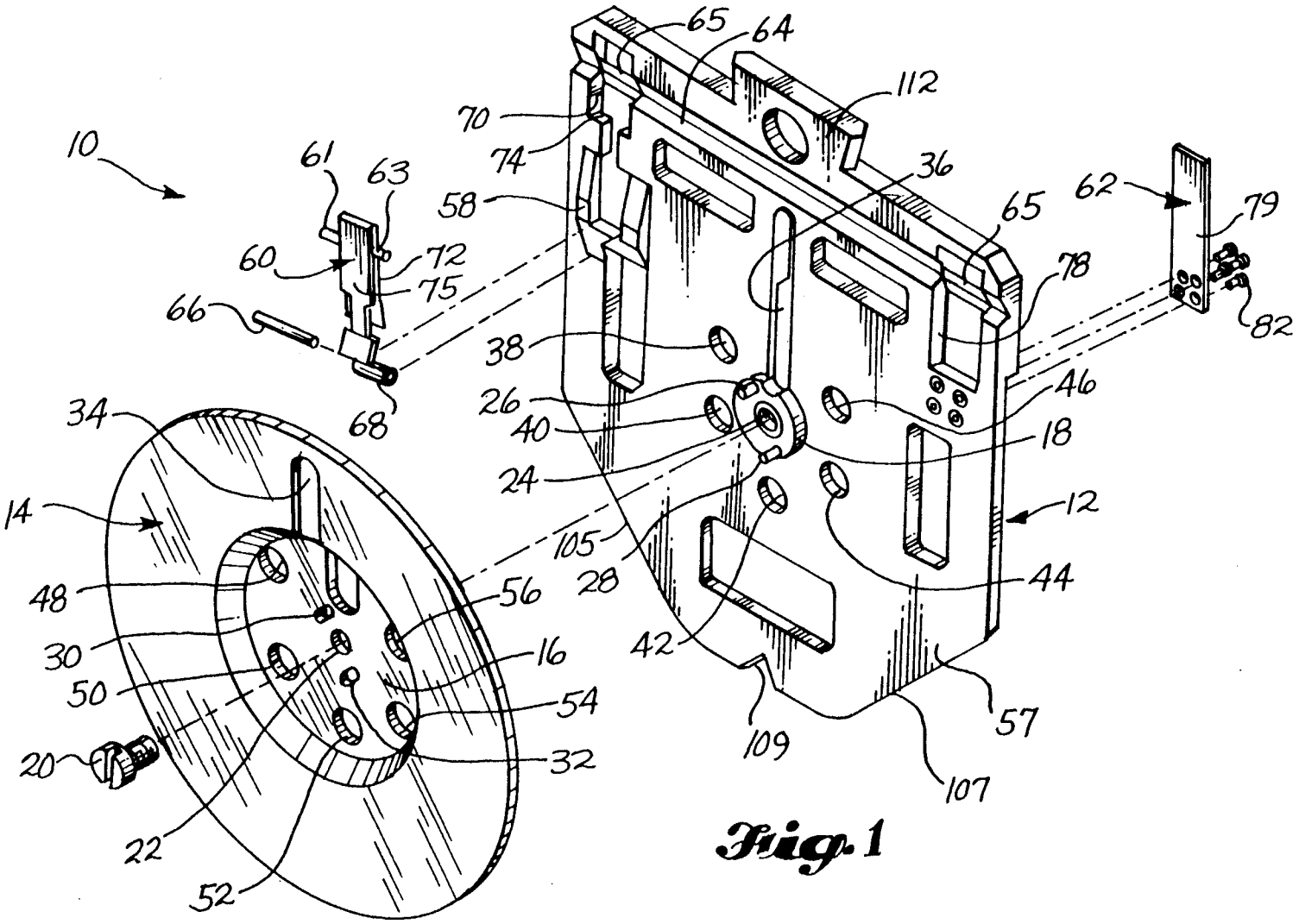
FIG. 1 is an exploded pictorial view of a wire reel in accordance with a preferred embodiment of the present invention.

Referring now to the drawings, and first to FIG. 1, shown generally at 10 is a wire reel in accordance with a preferred embodiment of the present invention. The reel 10 has a generally planar stiffback member, or stiffback 12, to which is connected a circular flange member, or flange 14.

A central portion or hub region 16 of the flange 14 is releasably connected to a circular pedestal 18 on the stiffback 12 by means of a conventional screw 20, or by a thumb-twist, quick-turn type screw. The end of the screw 20 extends through a center opening 22 in hub portion 16, and is threaded into the pedestal 18 at the location indicated by reference numeral 24.

The pedestal 18 has a pair of forwardly-projecting pins 26, 28, which extend through corresponding holes 30, 32 in the hub region 16 of the flange 14. This aligns a vertical slot 34 in the flange 14 with a similar slot 36 extending through the stiffback 12, and also ensures that pin openings 38, 40, 42, 44, 46 in the stiffback 12 will align with corresponding pin openings 48, 50, 52, 54, 56 in the flange 14. The purpose and function of these various slots and pin openings will be further described later.

The face 57 of the stiffback or, in other words, that surface of the stiffback which faces the flange 14, is substantially flat, except for a pin-holding structure 58 in the upper, left-hand portion of the stiffback 12. Thus, face 57 defines a winding plane for coiling a wire segment onto the reel 10.

First and second wire clamps 60, 62 are respectively located on the upper left and right-hand corners of the stiffback 12. A V-shaped groove 64 extends all the way across the top of the stiffback 12, and interconnects the first and second clamps 60, 62. The purpose of the groove 64 is to guide the leading end of a wire segment across the top of the stiffback and into a position where it can be clamped by the second clamp 62. This is further described below.

The first clamp 60 is connected to the stiffback 12 by means of a pin 66 that extends through a lower portion 68 of the, clamp, the pin 66 being retained in the pin-holding structure 58 described above.

Figure 5:
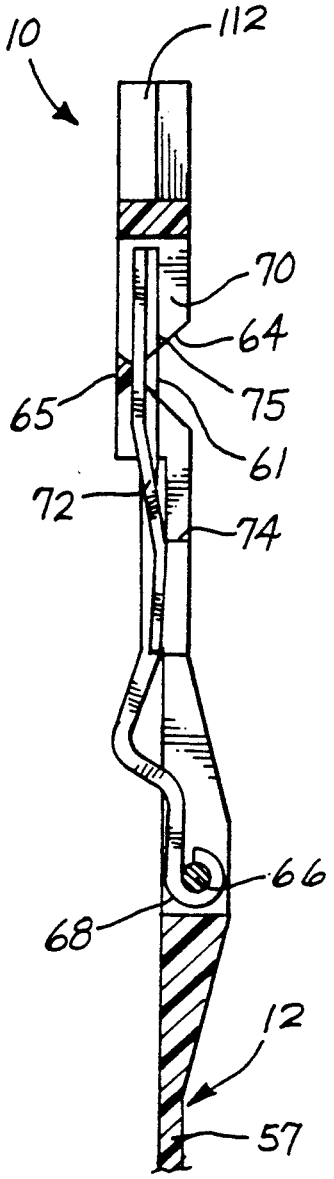
FIG. 5 is a fragmentary cross-sectional view taken through the upper left-hand corner of the reel shown in FIGS. 1 and 7, with the clamp shown in elevation.
Figure 6:
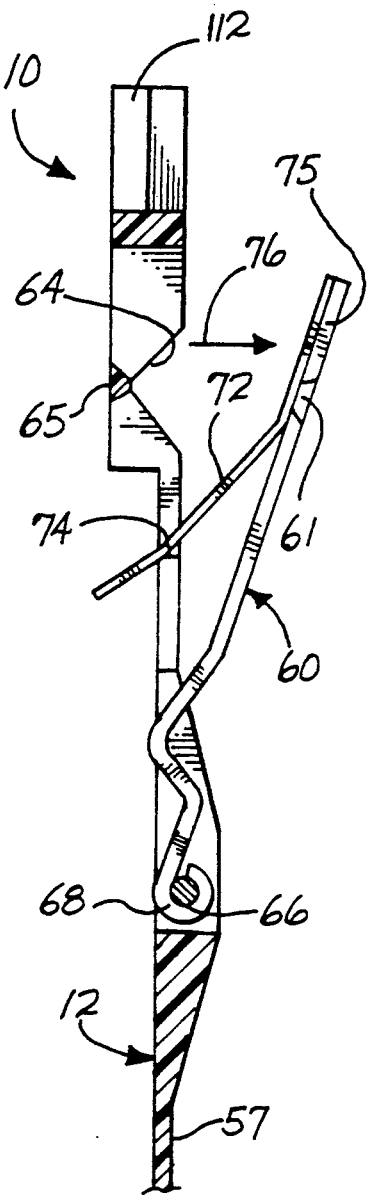
FIG. 6 is a view like FIG. 5, but shows a flexible clamp being pushed away from a groove in the reel, for the purpose of feeding a leading end of a wire segment along the groove.

Referring briefly to FIGS. 5 and 6, the first clamp 60 is positioned in and across an opening 70 that extends through the thickness of the stiffback 12. The first clamp 60 has a flexible portion made of spring steel 72 that is hooked or otherwise extends over the bottom edge 74 (see FIG. 6) of stiffback opening 70. Such portion is fixedly connected to a strip of spring steel 75 which performs the clamping function. When the clamp 60 is pushed toward the circular flange 14, in the direction indicated by arrow 76 in FIG. 6, the spring portion 72 opposes such movement, and upon release, retracts the clamp 60 back to the position shown in FIG. 5. This operation is used to clamp at least a portion of a wire segment along the groove 64, in a manner which is further described below. During such clamping action, the flexible spring steel portion 72 tends to urge the wire into the groove 64.

The first clamp 60 also has a pair of tabs 61, 63 which extend outwardly in opposite directions. These tabs 61, 63 function to hold the wire in the groove 64.

Figure 4:
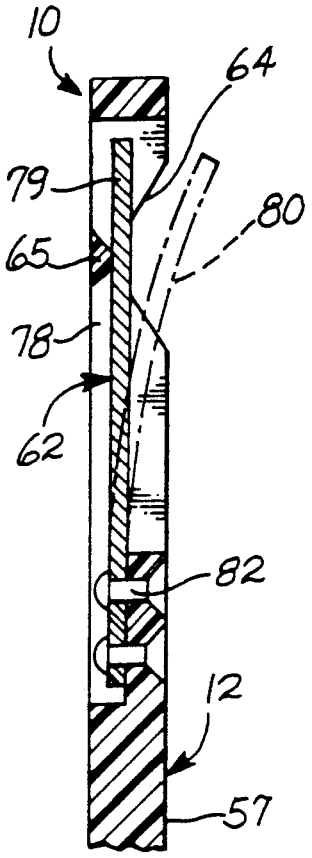
FIG. 4 is a fragmentary cross-sectional view taken through the upper right-hand corner of the reel shown in FIGS. 1 and 7.
Figure 12:
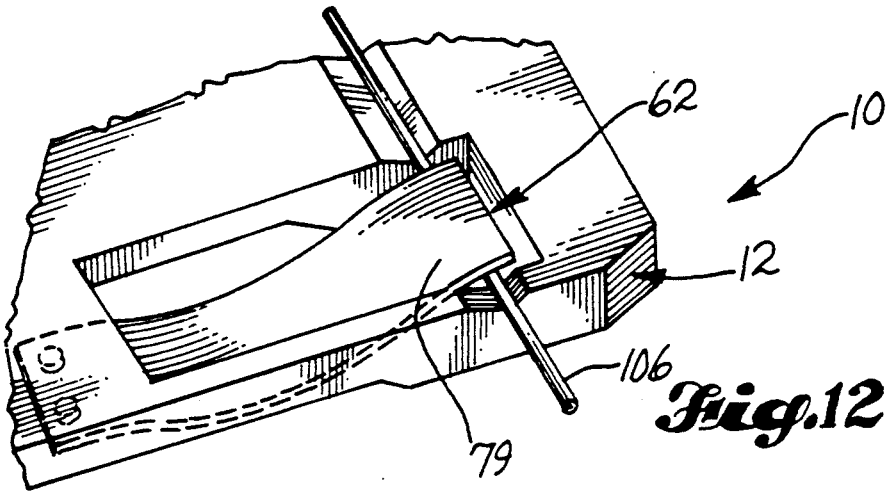
FIG. 12 is an enlarged fragmentary pictorial view of the upper right-hand corner of the reel shown in FIGS. 1 and 7, and illustrates how the leading end of a wire segment is clamped to the reel at that particular corner.

Referring now to FIG. 4, the second clamp 62 is constructed somewhat differently than the first clamp 60, although its operation is substantially the same. Specifically, the second clamp 62 is made of a single piece or strip of flexible spring steel 79 that is elastically bendable, and is normally positioned within and across a second opening 78 in the stiffback 12. Pushing the flexible strip 79 into the position indicated by dashed lines 80 enables the leading end of a wire segment to be extended between the strip 79 and the V-shaped groove 64. Releasing the strip 79 then causes it to press against the wire as shown in FIG. 12. In this clamped position, the second clamp 62 locates and maintains the leading end of the wire segment in an offset relationship relative to the winding plane defined by the face 57 of the stiffback member 12, to prevent the leading end from interfering with coiling of the wire segment onto the reel 10. The second clamp 62 is mounted to the stiffback via conventional rivets 82.

Referring to FIG. 1, it can be seen that a bridge of material 65 extends across both the upper left-hand and right-hand openings 70, 78 in the stiffback 12. The purpose of such bridge is to provide an underlying support surface upon which the leading end of a wire segment may cross openings 70, 78 as it moves along groove 64, and for providing a surface upon which the wire can rest as it is pressed by the clamps 60, 62.

Figure 7:
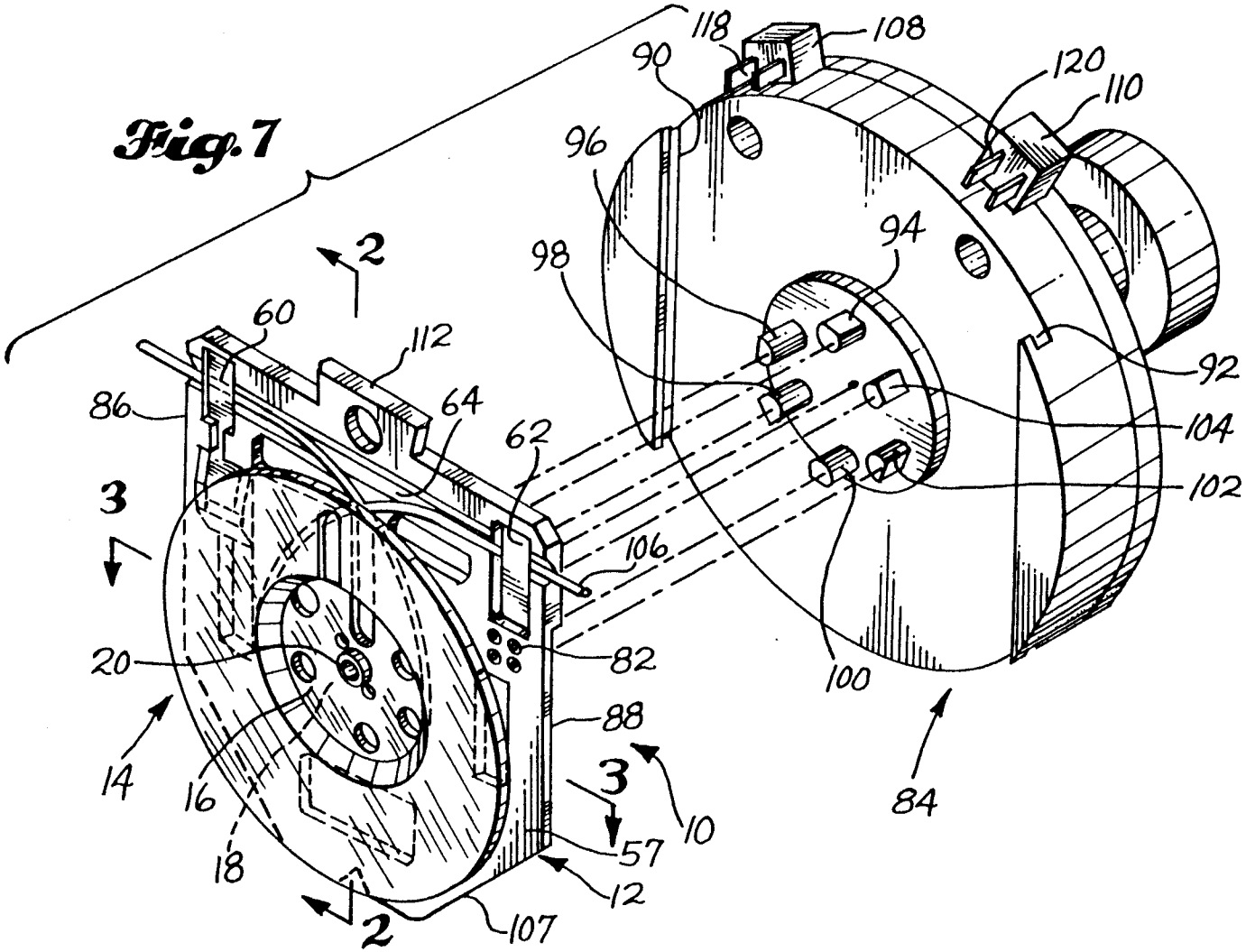
FIG. 7 is a view like FIG. 1, but shows how a wire segment is coiled and clamped onto the reel.
Figure 10:
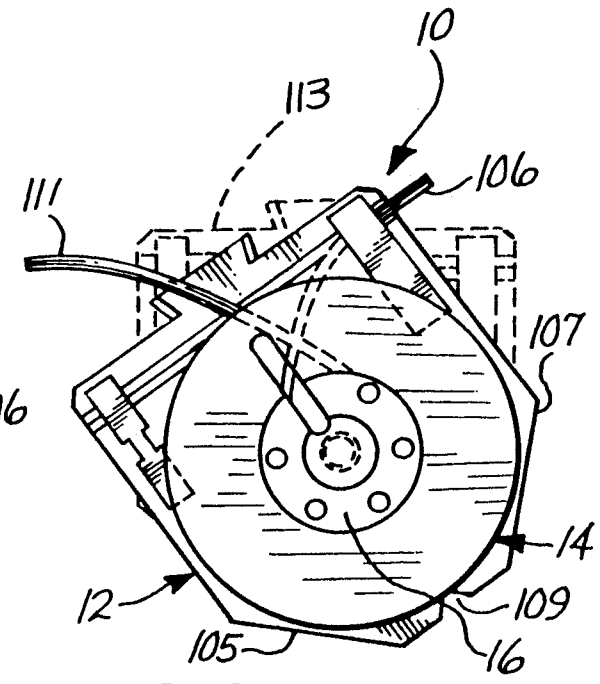
FIG. 10 is a view like FIGS. 8 and 9, but shows the reel in still another rotational position.

Referring now to FIGS. 7–11, the way the reel 10 is to be used in conjunction with an automated system will now be described. Referring first to FIG. 7, when a wire segment is spooled or coiled onto the reel 10, the reel is first mounted onto a reeler head, like the one shown generally at 84 in FIG. 7. The reeler head has a plurality of retractable reeler pins 94, 96, 98, 100, 102, 104 which are engaged with the holes and slot 36, 38, 40, 42, 44, 46 of the stiffback 12, and the holes and slot 34, 48, 50, 52, 54, 56 of the flange 14.

The reel 10 is mounted to the reeler head 84 by sliding it downwardly so that its outer edges 86, 88 are in sliding engagement with corresponding slots 90, 92 on opposite lateral sides of the reeler head. This is done when the pins 94, 96, 98, 100, 102, 104 are in a retracted condition. Thereafter, such pins are extended through the holes in the stiffback 12 and flange 14 as just described, for coiling a wire segment onto the reel 10.

The stiffback portion 12 has a pair of symmetrically converging lower edges 105, 107 which assist guiding the stiffback 12 into the grooves 90, 92 on the reeler head 84 (see FIG. 7). It also has a "V"-shaped notch 109 which may serve as a guide for positioning the reel in a storage position, in a manner that will be further described later.

The purpose of the reeler head pins 94, 96, 98, 100, 102, 104 is not to define or provide a mechanism for driving the reel 10 in rotation. Instead, rotational power is transmitted via head slots 90, 92 or some equivalent means. The purpose of the head pins 94, 96, 98, 100, 102, 104 is to define the radius about which the wire segment is coiled, and to bear the brunt of the tension in the wire that results from the coiling process, as opposed to enabling such tension to place stress on the reel itself. This need not be further explained here as it is the subject of my co-pending application (application Ser. No. 07/892,275 referenced above.

Figure 8:
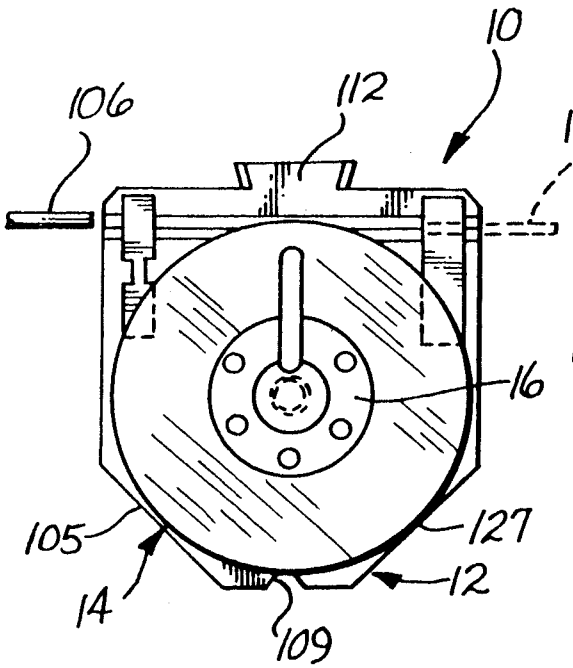
FIG. 8 is the first of a series of three views showing how a wire segment is wound or coiled onto the reel shown in FIGS. 1 and 7, and presents a frontal view of the reel.

Referring now to FIG. 8, in operation, a first or leading end of a wire segment 106 is passed across the top portion of the stiffback 12 to the position indicated by dashed lines 106' in FIG. 8. During such operation, the first clamp 60 is in a closed condition, and the end of the wire simply passes over it as it follows the V-shaped groove 64. However, the second clamp 62 is in an open condition at that time, and the end of the wire passes between its flexible member 79 and the bridge 65 across opening 78 until it reaches the position shown at 106' in FIG. 8. Thereafter, the second clamp 62 is allowed to close, fixing the wire in place.

Referring again to FIG. 7, opening and closing movement of both clamps 60, 62 are driven by actuators 108, 110 that are mounted to the reeler head 84. These actuators have members 118, 120 that are extendible through the openings 70, 78 in the stiffback, for pushing the clamps 60, 62 toward the flange 14 in order to achieve an open condition. Naturally, actuators 108, 110 would be under the control of whatever automated handling system uses the reeler head 84.

After the leading end of the wire 106 is clamped by the second clamp 62 in the manner shown in FIG. 8, (see also FIG. 12), the reel 10 is driven in rotation until a predetermined length or segment of wire is wound or coiled onto the reel. Since it is anticipated that the length of individual segments will vary, the number of rotations required will vary from one segment to the next. Further, it is likely that rotating movement of the reel may end in a different position than when the coiling process started.

Figure 9:
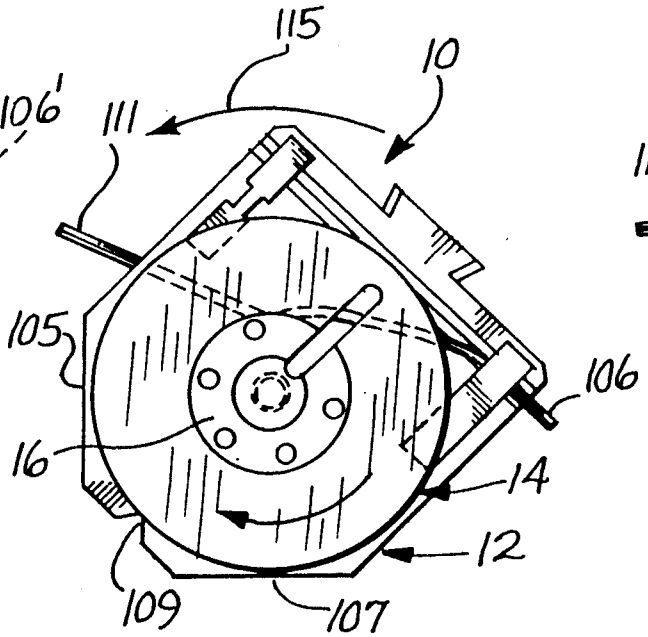
FIG. 9 is a view like FIG. 8, but shows the reel in a different rotational position.

This is illustrated in FIG. 9, for example. In such case, and as is apparent, what would be the second or opposite end of the segment 111, at least prior to the time it is severed, is not in a position to be gripped by the first clamp 60. Therefore, it is anticipated that the reel 10 would be counter-rotated, as shown by arrow 115, to the position shown in FIG. 10. At which time, the first clamp 60 is opened. Then, rotation of the reel 12 is again reversed and the reel rotated to substantially the position shown by dashed lines 113, with the first clamp 60 remaining open. During such movement, the aft end 111 of the wire would move into a position where it can be captured by the first clamp 60. After capture, the aft end 111 is severed, thus completing the winding process.

Figure 2:
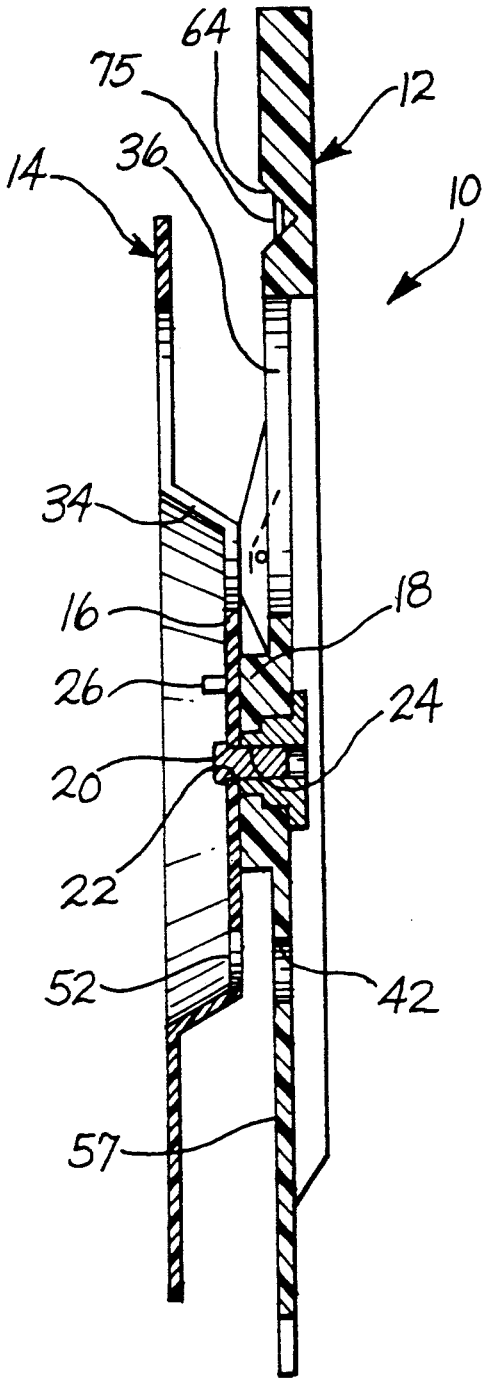
FIG. 2 is a cross-sectional view of the reel shown in FIG. 1, and is taken along line 2—2 in FIG. 7.
Figure 3:
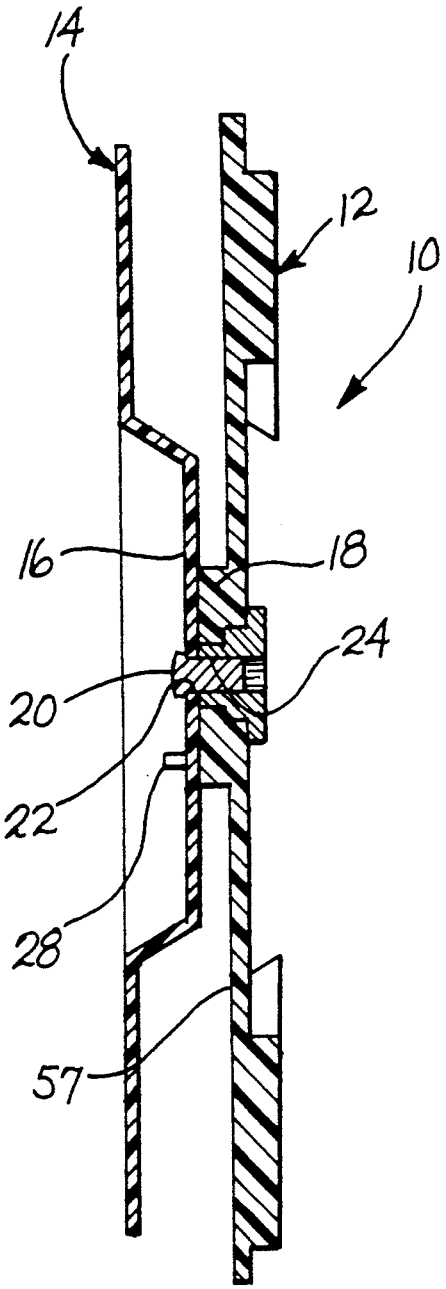
FIG. 3 is a cross-sectional view like FIG. 2, but is taken along line 3—3 in FIG. 7.

An alternative, and perhaps preferable method for capturing the aft end 111 of the segment is as follows: at the end of winding, the pins 94, 96, 98, 100, 102, 104 in the reeler head 84 are withdrawn. This creates additional space between the winding circle defined by the pins and the inner hub defined by the pedestal 18 (see FIGS. 2 and 3), and creates slack for tightening at least some of the wire coils on the reel. Then, the reel is rotated further, but in the same direction, while no further wire is allowed to play out from the wire feed source. One or more coils are drawn down to the inner hub 18 as the reel is rotated and therefore do not impede this further rotation. At the same time, the second clamp 60 is opened and is ready to capture the aft end 111 of the wire when the reel rotates into the position shown at 113 in FIG. 10. Then, the clamp 60 is closed, and the wire is cut.

Figure 11:
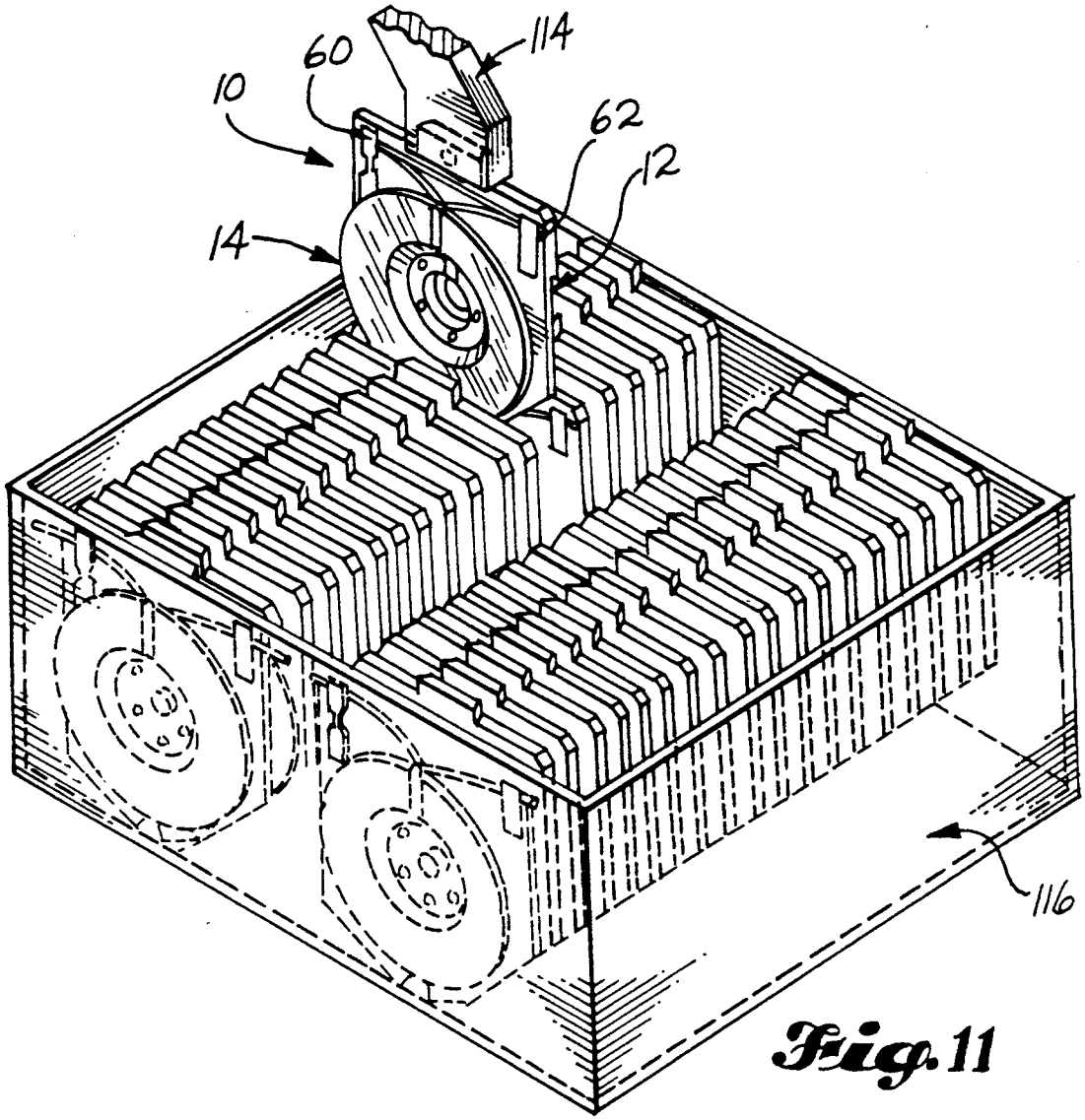
FIG. 11 is a pictorial view of a robotic handling device, and shows how such device places individual reels in a storage box or cabinet.

The stiffback 12 of the reel 10 has portions that are shaped to be engaged by a robotic handling device. In particular, the upper portion of the stiffback 12 has a center flange 112 that projects upwardly. Referring to FIG. 11, such flange 112 is grippable by a robotic arm 114, which enables individual reels to be moved from place to place as needed in order to use the wire coiled on the reel 10, or for storage, as the case may be. FIG. 11 shows the robotic arm 114 placing the reel 10 in a storage cabinet 116, for example. The "V"-shaped notch 109 in the bottom of the stiffback 12 may assist positioning the reel 10 in the cabinet 116.

One of the advantages of the reel 10 is that the flange 14 is easy to disconnect from the stiffback 12 This makes the removal of coiled wire segments extremely easy, if required. There may be situations, for example, where the volume of segments handled in a given automated system may require far more reels than are available, making it necessary to remove processed coils from individual reels from time to time so that the reels may be recycled or reused immediately. If such is the case, then a coiled segment may be bound together by a conventional wire tie that is extended around the segment prior to its removal from the reel 10. This is accomplished by extending the tie through the slots 34, 36 in the flange and stiffback, and around the coil. Then, the coil will stay together after the flange is removed from the stiffback.

It is to be understood that the above description sets forth the best mode for carrying out what is claimed as being the invention. The reel disclosed here is the subject of ongoing research and development efforts within The Boeing Company. Therefore, it is conceivable that other embodiments may be developed that depart somewhat from the embodiment disclosed above. Accordingly, the spirit and scope of what is considered to be the invention is not to be limited by the preceding description, nor the appended drawings. Instead, what is considered to be the invention is defined by the subjoined patent claim or claims which follow, and it is to be understood that such claims are to be interpreted in accordance with the well-established doctrines of patent claim interpretation.

What is claimed is:

1. A wire reel for use in conjunction with automated handling of wire segments, comprising:

a rigid, generally planar stiffback member having portions that are engageable by a robotic handling device;

a flange member having a central portion that is removably connected to said stiffback member, said flange member including an outer peripheral portion that is spaced apart from said stiffback member in a manner so as to define a circular winding space for coiling a wire segment onto said reel; and first and second circumferentially spaced-apart wire clamps mounted on said stiffback member for holding opposite ends of said wire segment in predetermined positions after said wire segment has been coiled onto said reel.

2. The wire reel of claim 1, wherein said first and second wire clamps are arranged radially outwardly of the perimeter of said outer peripheral portion of said flange member.

3. The wire reel of claim 1, wherein said stiffback member includes at least one opening through said stiffback member adjacent each clamp, for enabling an actuator member to push said clamp to open said clamp during a clamping operation.

4. A wire reel for use in conjunction with automated handling of wire segments, comprising;

a rigid, generally planar stiffback member having portions that are engageable by a robotic handling device;

a flange member having a central portion that is removably connected to said stiffback member, said flange member including an outer peripheral portion that is spaced apart from said stiffback member in a manner so as to define a circular winding space for coiling a wire segment onto said reel; and first and second circumferentially spaced-apart wire clamps mounted on said stiffback member for holding opposite ends of said wire segment in predetermined positions after said wire segment has been coiled onto said reel;

wherein said first and second wire clamps are arranged radially outwardly of the perimeter of said outer peripheral portion of said flange member; and wherein said stiffback member has a substantially flat surface that faces said flange member, said flat surface defining a winding plane for coiling said wire segment onto said reel; and said stiffback member has an opening, extending through said flat surface, in which at least a portion of one of said wire clamps is positioned to locate and maintain a leading end of said wire segment in offset relationship relative to said winding plane, for preventing said leading end from interfering with coiling of said wire segment.

5. The wire reel of claim 4, wherein said stiffback member has a groove extending along said flat surface at least between said first and second clamps, for guiding said leading end of said wire segment into a position where said leading end can be held by one of said clamps.

6. The wire reel of claim 5, wherein said groove is generally V-shaped.

7. The wire reel of claim 6, wherein each clamp includes an elastically flexible member adapted to normally urge said clamp toward said groove, and further including at least one opening through said stiffback member adjacent each clamp, for enabling an actuator member to push said clamp away from said groove, for opening said clamp during a clamping operation.

8. A wire reel for use in conjunction with automated handling of wire segments, comprising:

a rigid, generally planar stiffback member having portions that are engageable by a robotic handling device;

a flange member having a central portion that is removably connected to said stiffback member, said flange member including an outer peripheral portion that is spaced apart from said stiffback member in a manner so as to define a circular winding space for coiling a wire segment onto said reel; and first and second circumferentially spaced-apart wire clamps mounted on said stiffback member for holding opposite ends of said wire segment in predetermined positions after said wire segment has been coiled onto said reel;

wherein a lower portion of said stiffback member has symmetrically converging edges.

9. A wire reel for use in conjunction with automated handling of wire segments, comprising:

a rigid, generally planar stiffback member having portions that are engageable by a robotic handling device;

a flange member having a central portion that is removably connected to said stiffback member, said flange member including an outer peripheral portion that is spaced apart from said stiffback member in a manner so as to define a circular winding space for coiling a wire segment onto said reel; and first and second circumferentially spaced-apart wire clamps mounted on said stiffback member for holding opposite ends of said wire segment in predetermined positions after said wire segment has been coiled onto said reel;

wherein said stiffback member has a substantially flat surface that faces said flange member, and a groove extending along said flat surface at least between said first and second clamps; said flat surface defining a winding plane for coiling said wire segment onto said reel, and said groove providing a guide for guiding a leading end of said wire segment into a position where said leading end can be held in said groove by one of said clamps.

10. The wire reel of claim 9, wherein each clamp includes an elastically flexible member adapted to normally urge said clamp toward said groove, and further including at least one opening through said stiffback member adjacent each clamp, for enabling an actuator member to push said clamp away from said groove, for opening said clamp during a clamping operation.

11. The wire reel of claim 10, wherein said stiffback member comprises a bridge across each said opening to provide an underlying support surface for a leading end of a wire segment moving along said groove and for wire portions clamped by said clamps.

12. A wire reel for use in conjunction with automated handling of wire segments, comprising:

a rigid, generally planar stiffback member having portions that are engageable by a robotic handling device;

a flange member having a central portion that is removably connected to said stiffback member, said flange member including an outer peripheral portion that is spaced apart from said stiffback member in a manner so as to define a circular winding space for coiling a wire segment onto said reel; and first and second circumferentially spaced-apart wire clamps mounted on said stiffback member for holding opposite ends of said wire segment in predetermined positions after said wire segment has been coiled onto said reel;

wherein said stiffback member includes at least one opening through said stiffback member adjacent each clamp, for enabling an actuator member to push said clamp to open said clamp during a clamping operation; and wherein at least a portion of one of said clamps is positioned in its corresponding opening to locate and maintain a leading end of a wire segment in offset relationship relative to said winding space, to prevent said leading end from interfering with coiling of said wire segment; and said stiffback member comprises a bridge across said opening to provide an underlying support surface for said leading end when said leading end is clamping by said clamp.

* * * * *

UNITED STATES PATENT AND TRADEMARK OFFICE

CERTIFICATE OF CORRECTION

PATENT NO. : 5,320,301

DATED : June 14, 1994

INVENTOR(S) : Dan A. Cross

It is certified that error appears in the above-identified patent and that said Letters Patent is hereby corrected as shown below:

Column 1, line 35, after "typically", insert -- made up of bundles of individual wires, which are assembled --.
Column 2, line 44, "c lamp" should be -- clamp --.
Column 4, line 3, delete the comma after "the", first occurrence.
Column 5, line 21, "07/892,275" should be -- 07/892,275) --.
Column 6, line 29, there is a period after "stiffback 12".

Signed and Sealed this

Fifteenth Day of November, 1994

*Attest:*

*Attesting Officer*

Bruce Lehman

BRUCE LEHMAN

*Commissioner of Patents and Trademarks*